US006608611B2

(12) United States Patent
Lim

(10) Patent No.: US 6,608,611 B2
(45) Date of Patent: Aug. 19, 2003

(54) ADDRESS DRIVING METHOD OF PLASMA DISPLAY PANEL

(75) Inventor: Geun Soo Lim, Kyounggi-do (KR)

(73) Assignee: LG Electronics Inc., Seoul (KR)

( * ) Notice: Subject to any disclaimer, the term of this patent is extended or adjusted under 35 U.S.C. 154(b) by 306 days.

(21) Appl. No.: 09/727,387

(22) Filed: Dec. 1, 2000

(65) Prior Publication Data

US 2001/0005187 A1 Jun. 28, 2001

(30) Foreign Application Priority Data

Dec. 4, 1999 (KR) ..... 99-55027

(51) Int. Cl.[7] ..... G09G 3/28; G09G 3/20
(52) U.S. Cl. ..... 345/67; 345/60; 345/55
(58) Field of Search ..... 345/55–72, 208–210

(56) References Cited

U.S. PATENT DOCUMENTS 3,881,129 A * 4/1975 Nakayama et al. ..... 345/67
3,886,404 A * 5/1975 Kurashashi et al. ..... 345/67
4,924,218 A * 5/1990 Weber et al. ..... 345/67
5,900,694 A * 5/1999 Matsuzaki et al. ..... 313/484
6,034,482 A * 3/2000 Kanazawa et al. ..... 315/169.4
6,043,605 A * 3/2000 Park ..... 313/586
6,084,559 A * 7/2000 Nagao et al. ..... 345/67
6,195,074 B1 * 2/2001 Kim ..... 345/67
6,243,073 B1 * 6/2001 Kawamura et al. ..... 345/690
6,404,411 B1 * 6/2002 Masuda et al. ..... 345/66

FOREIGN PATENT DOCUMENTS

KR 1999-65106 8/1999
KR 1999-74746 10/1999

* cited by examiner

*Primary Examiner*—Steven Saras
*Assistant Examiner*—Michael J. Moyer
(74) *Attorney, Agent, or Firm*—Fleshner & Kim, LLP

(57) ABSTRACT

An address driving method of a plasma display panel that permits a stable high-speed addressing. In the method, a data pulse is applied to an address electrode and applying a scanning pulse to a scanning electrode, to thereby generating an address discharge in the selected cell. Also, an auxiliary pulse is to an auxiliary electrode parallel to the address electrode, to thereby generating an auxiliary discharge. Accordingly, the auxiliary discharge is used to largely shorten a discharge delay time, thereby permitting a high-speed addressing. Also, the auxiliary pulse having the same polarity as the data pulse is applied to prevent an erroneous discharge between the auxiliary electrode and the data electrode.

17 Claims, 13 Drawing Sheets

ADDRESS DRIVING METHOD OF PLASMA DISPLAY PANEL

BACKGROUND OF THE INVENTION

1. Field of the Invention

This invention relates to a method of driving a plasma display panel, and more particularly to an address driving method of a plasma display panel that permits a stable high-speed addressing.

2. Description of the Related Art

Generally, a plasma display panel (POP) radiates a fluorescent body by an ultraviolet with a wavelength of 147 nm generated during a discharge of He+Xe or Ne+Xe gas to thereby display a picture. Such a PDP is easy to be made into a thin-film and large-dimension type. Moreover, the PDP provides a very improved picture quality owing to a recent technical development. Such a PDP typically includes a surface-discharge alternating current (AC) type PDP that has three electrodes as shown in FIG. 1 and is driven with an alternating current voltage.

FIG. 1 is a perspective view of a discharge cell of a conventional three-electrode, AC-type PDP. Referring to FIG. 1, the discharge cell includes an upper substrate 10 provided with a sustaining electrode pair 12 and 14, and a lower substrate 20 provided with an address electrode 22. The upper substrate 10 and the lower substrate 20 are spaced, in parallel to each other, with having a barrier rib 26 therebetween. A mixture gas such as Ne—Xe or He—Xe, etc. is injected into a discharge space defined by the upper substrate 10 and the lower substrate 20 and the barrier rib 26. Any one electrode 12 of the sustaining electrode pair 12 and 14 is used as a scanning/sustaining electrode that responds to a scanning pulse applied in the address interval to cause an opposite discharge along with the address electrode 22, and responds to a sustaining pulse applied in the sustaining interval to cause a surface discharge along with the adjacent sustaining electrode 14. The sustaining electrodes 14 adjacent to the sustaining electrode 12 used as the scanning/sustaining electrode are used as a common sustaining electrode to which a sustaining pulse is applied commonly. On an upper substrate 10 provided with the sustaining electrode pair 12 and 14, an upper dielectric layer 16 and a protective film 18 are disposed. The upper dielectric layer 16 is responsible for limiting a plasma discharge current as well as accumulating a wall charge during the discharge. The protective film 18 prevents a damage of the upper dielectric layer 16 caused by a sputtering generated during the plasma discharge and improves an emission efficiency of secondary electrons. This protective film 18 is usually made from MgO. The address electrode 22 crosses the sustaining electrode pair 12 and 14 and is supplied with a data signal for selecting cell to be displayed. A lower dielectric layer 24 is formed on the lower substrate 20 provided with the address electrode 22. The barrier ribs 26 for dividing the discharge space are extended perpendicularly on the lower dielectric layer 24. The surfaces of the lower dielectric layer 24 and the barrier rib 26 is coated with a fluorescent material 28 excited by a vacuum ultraviolet ray to generate a red, green or blue visible light.

The PDP discharge cell having the structure as described above sustains a discharge by a surface discharge between the sustaining electrode pair 12 and 14 after being selected by an opposite discharge between the address electrode 22 and the scanning/sustaining electrode 12. The fluorescent material 28 is radiated by an ultraviolet ray generated during the sustaining discharge to emit a visible light into the exterior of the cell. In this case, a discharge sustaining interval, that is, a sustaining discharge frequency of the cell is controlled to realize a gray scale required for an image display.

An arrangement of the entire electrode lines and discharge cells of the AC surface-discharge PDP is as shown in FIG. 2. In FIG. 2, the discharge cell 30 is positioned at each intersection among m address electrode lines X1 to Xm, n scanning/sustaining electrode lines Y1 to Yn and n common sustaining electrode lines Z1 to Zn. The address electrode lines X1 to Xm are divided into odd-numbered lines and even numbered lines to be individually driven at the upper and lower portion thereof, respectively. The scanning/sustaining electrode lines Y1 to Yn are individually driven while the common sustaining electrode lines Z1 to Zn are commonly driven.

Such a PDP driving method typically includes a sub-field driving method in which the address interval and the discharge sustaining interval are separated. In the sub-field driving method as shown in FIG. 3, one frame 1F is divided into n bits for example, 8 sub-fields SF1 to SF8 corresponding to each bit of an 8-bit image data, and each sub-field SF1 to SF8 is again divided into a reset interval RPD, an address interval APP and a discharge sustaining interval SPD. The reset interval RPD is an interval for initializing the discharge cell, the address interval APD is an interval for generating a selective address discharge in accordance with a logical value of a video data, and the sustaining interval SPD is an interval for allowing a discharge to be sustained at the discharge cell 12 in which the address discharge has been generated. The reset interval RPO and the address interval APD are equally allocated in each sub-field interval. A weighting value with a ratio of $2^0:2^1:2^2: \ldots :2^{n-1}$, i.e., 1:2:4:8:16:32:64:128 is given to the discharge sustaining interval SPD to express a gray scale by a combination of the discharge sustaining intervals SPD.

FIG. 3 is waveform diagrams of driving signals applied to the PDP shown in FIG. 2 in a certain one sub-field interval SFi. In the reset interval RPD, a priming pulse Pp is commonly applied to the scanning/sustaining electrode lines Y1 to Yn and the common sustaining electrode lines Z1 to Zn. By this priming pulse Pp, a reset discharge is generated between each common sustaining electrode and each scanning/sustaining electrode of the entire discharge cells 30 to initialize the discharge cells 30. By the reset discharge, a large amount of wall charges are formed at the common sustaining electrode and the scanning/sustaining electrode of each discharge cell 30.

Subsequently, a self-erasure discharge is generated at the discharge cells by the large amount of wall charges to eliminate the wall charges and leave a small amount of charged particles. These small amount of charged particles help an address discharge in the following address interval. In the address interval APD, a scanning voltage pulse SCp is applied line-sequentially to the scanning/sustaining electrode lines Y1 to Yn. At the same time, a data pulse Dp according to a logical value of a data is applied to the address electrode lines X1 to Xm. Thus, an address discharge is generated at discharge cells to which the scanning voltage pulse SCp and the data pulse Dp are simultaneously applied. Wall charges are formed at the discharge cells in which the address discharge has been generated. During this address interval, a desired constant voltage is applied to the common sustaining electrode lines Z1 to Zn to prevent a discharge between each address electrode line and each common sustaining electrode line. In the sustaining interval SPD, a sustaining pulse Sp is alternately applied to the first to mth scanning/sustaining electrode lines Y1 to Ym and the common sustaining electrode lines Z1 to Zn. Accordingly, a sustaining discharge is generated continuously only at the discharge cells formed with the wall charges by said address discharge to emit a visible light. Then, in a separate erasure interval EPD, an erasing pulse Ep is applied to the common sustaining electrode lines Z1 to Zn to interrupt the sustained discharge.

In the conventional AC, surface-discharge PDP driven as described above, there has been used a scheme of lengthening a pulse width Td of address drive pulses Dp and SCp into more than 2.5 μs or enlarging a voltage level of the address drive pulses Dp and SCp in order to obtain a stable discharge characteristic. If a voltage level of the address drive pulse Dp and SCp are lowered, then a discharge intensity and a produced amount of charged particles are reduced. If the address drive pulses Dp and SCp is shortened into a pulse width T1 at such a low voltage level state, then a mis-discharge or an erroneous discharge may be generated due to a discharge delay phenomenon which is an inherent characteristic of the PDP. Such an unstable address discharge problem can be solved by lengthening the pulse width T1 of the drive pulses Dp and SCp.

However, when the pulse width T1 of the address drive pulses Dp and SCp is set to have a large value of more than 2.5 μs, a ratio occupied by the sustaining interval SPD dominating a brightness of a real picture in a state in which a period of one frame 1F has been fixed to 16.67 ms is reduced to less than 30% to deteriorate the brightness. Also, a recent PDP driving method has increased the number of sub-fields in one frame 1F from 8 sub-fields in the prior art into 10 to 12 sub-fields so as to reduce a contour noise which is an inherent picture quality deterioration phenomenon. If the number of sub-fields increases during the fixed one frame interval, a sustaining interval of each sub-field is shortened to thereby largely deteriorate a picture brightness. Furthermore, in the case of a high-resolution POP having a lot of scanning lines, an address interval is more lengthened and thus a sustaining interval is shortened to that extent, thereby making a picture display impossible, In order to overcome such a problem, there has been implemented various method for reducing an address interval using a high-speed addressing. One example of these methods is to divide scanning lines into upper and lower lines to drive them. In this scanning line division driving system, scanning lines are divided into the upper and lower lines to drive the upper scanning lines and the lower scanning lines simultaneously with two different scanning drivers. Accordingly, the address interval is shortened into ½ and thus the sustaining interval is sufficiently assured, thereby preventing a brightness deterioration of a picture. However, the scanning line division driving system has a drawback in that, since the number of scanning and address driver integrated circuits (IC's) is increased to two times, a manufacturing cost of the PDP rises.

Another method for a high-speed addressing is to cause a auxiliary discharge during the address discharge to short an address interval. In order to generate the auxiliary discharge, a discharge cell 34 of a PDP as shown in FIG. 5 further includes a auxiliary electrode 32 formed, in parallel to an address electrode 22 on a lower substrate 20 in comparison to the discharge cell 30 shown in FIG. 1. In such a discharge cell 34, the address electrode 22 and a scanning/sustaining electrode 12 generate an address discharge and, at the same time, the auxiliary electrode 32 causes a auxiliary discharge along with the address electrode 22. In this case, a stable address discharge is generated with the aid of the auxiliary discharge even when a width of a voltage pulse for causing an address discharge is reduced.

FIG. 6 shows an entire electrode arrangement of a PDP in which said discharge cells 34 are arranged in a matrix type. In the PDP shown in FIG. 6, n scanning/sustaining electrode lines Y1 to Yn and common sustaining electrode lines Z1 to Zn are alternately arranged, and m address electrode lines X1 to Xm and m auxiliary electrode lines A1 to Am are arranged in such a manner to cross the scanning/sustaining electrode lines Y1 to Yn and the common sustaining electrode lines Z1 to Zn.

FIG. 7 is waveform diagrams of signals for driving the PDP shown in FIG. 6. In a reset interval RPD, a priming pulse Pp is commonly applied to the scanning/sustaining electrode lines Y1 to Yn and the common sustaining electrode lines Z1 to Zn. By this priming pulse Pp, a reset discharge is generated at all of the discharge cells 34 to initialize them. In an address interval APD, a negative(−) scanning voltage pulse SCp is line-sequentially applied to the scanning/sustaining electrode lines Y1 to Yn. At the same time, a positive(+) data pulse Dp according to a logical value of a data is applied to the address electrode lines X1 to Xm. Also, whenever the data pulse Dp is applied, a negative(−) auxiliary pulse Ap is applied to the auxiliary electrode lines A1 to Am. Accordingly, at discharge cells to which a positive(+) data pulse Dp is applied, an address discharge is generated between the address electrode and the scanning/sustaining electrode and an auxiliary discharge is further generated between the address electrode and the auxiliary electrode. In this case, sufficient priming charged particles are produced at the discharge space by virtue of the auxiliary discharge, a pulse width Td of a drive pulse for an address discharge, that is, the data pulse DP and the scanning pulse SCp can be shortened into Less than 1 μs. As a width of a driving pulse for an address discharge is shortened, an address interval APD in each sub-field is largely shortened into less then ½ in comparison to the prior art. Wall charges are produced at the discharge cells in which an address discharge has been generated. During this address interval APD, a desired constant voltage Vr is applied to the common sustaining electrode lines Z1 to Zn to prevent a discharge from being generated between each common sustaining electrode line and each address electrode line. In a sustaining interval SPD, a sustaining discharge is continuously generated only at the discharge cells in which wall charges are produced by said address discharge with the aid of a sustaining pulse SUSp applied alternately to the scanning/sustaining electrode lines Y1 and Yn and the common sustaining electrode lines Z1 to Zn. Then, in a separate erasure interval EPD, an erasing pulse Ep is applied to the common sustaining electrode lines Z1 to Zn to interrupt the sustained discharge.

However, the conventional PDP driving method employing the auxiliary discharge has a problem in that it has a high possibility for generating an erroneous discharge between the address electrode and the auxiliary electrode. This is caused by a fact that an auxiliary pulse having the same polarity as a scanning pulse, that is, a negative polarity is applied to the auxiliary electrode for the sake of an auxiliary discharge. More specifically, the conventional PDP driving method has a problem in that, if a positive(+) data pulse Dp is applied to the data electrode 22 and a negative(−) auxiliary pulse Ap is applied to the auxiliary electrode 32 even though a negative scanning pulse is not applied to the scanning/sustaining electrode 12, then an erroneous discharge may be generated at the discharge cells in which a discharge must not be generated due to a voltage difference between the data pulse Dp and the auxiliary pulse Ap. Furthermore, since it is general that the negative(−) voltage has slightly more difficulty than the positive(+) voltage in controlling them, a voltage level control of the negative(−) auxiliary pulse Ap applied to the auxiliary electrode 32 becomes difficult to more increase a possibility of the above-mentioned erroneous discharge.

SUMMARY OF THE INVENTION

Accordingly, it is an object of the present invention to provide an address driving method of a plasma display panel (PDP) that permits a stable high-speed addressing, In order to achieve these and other objects of the invention, an address driving method comprising the steps of: applying a data pulse to an address electrode and applying a scanning pulse to a scanning electrode, to thereby generating an address discharge in the selected cell; and applying an auxiliary pulse to an auxiliary electrode parallel to the address electrode, to thereby generating an auxiliary discharge.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
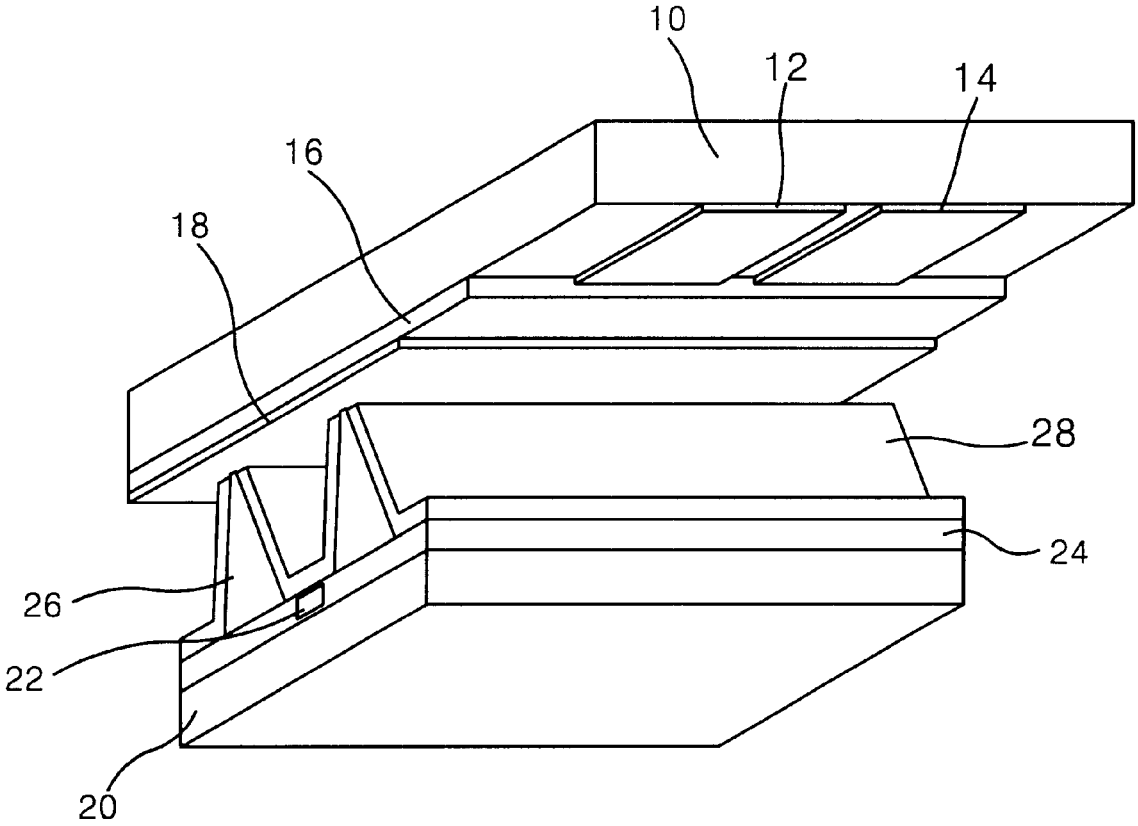
FIG. 1 RELATED ART
FIG. 1 is a perspective view showing a structure of a discharge cell of a conventional AC, surface-discharge type plasma display panel.
Figure 2:
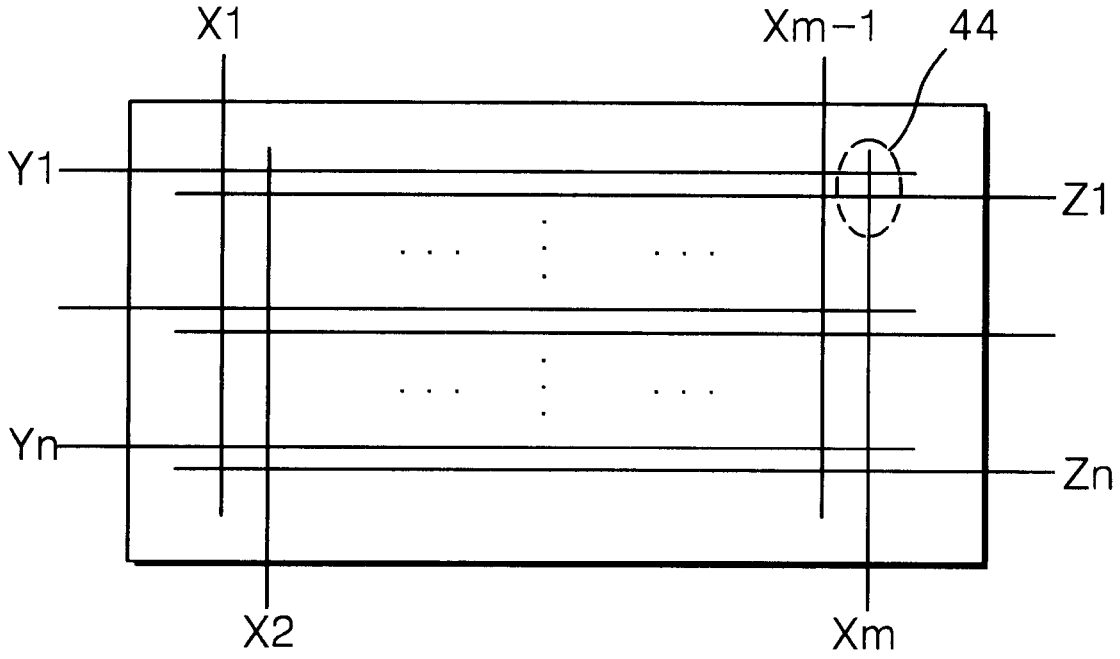
FIG. 2 RELATED ART
FIG. 2 is a plan view showing an entire electrode arrangement of a plasma display panel including the discharge cells of FIG. 1.
Figure 3:
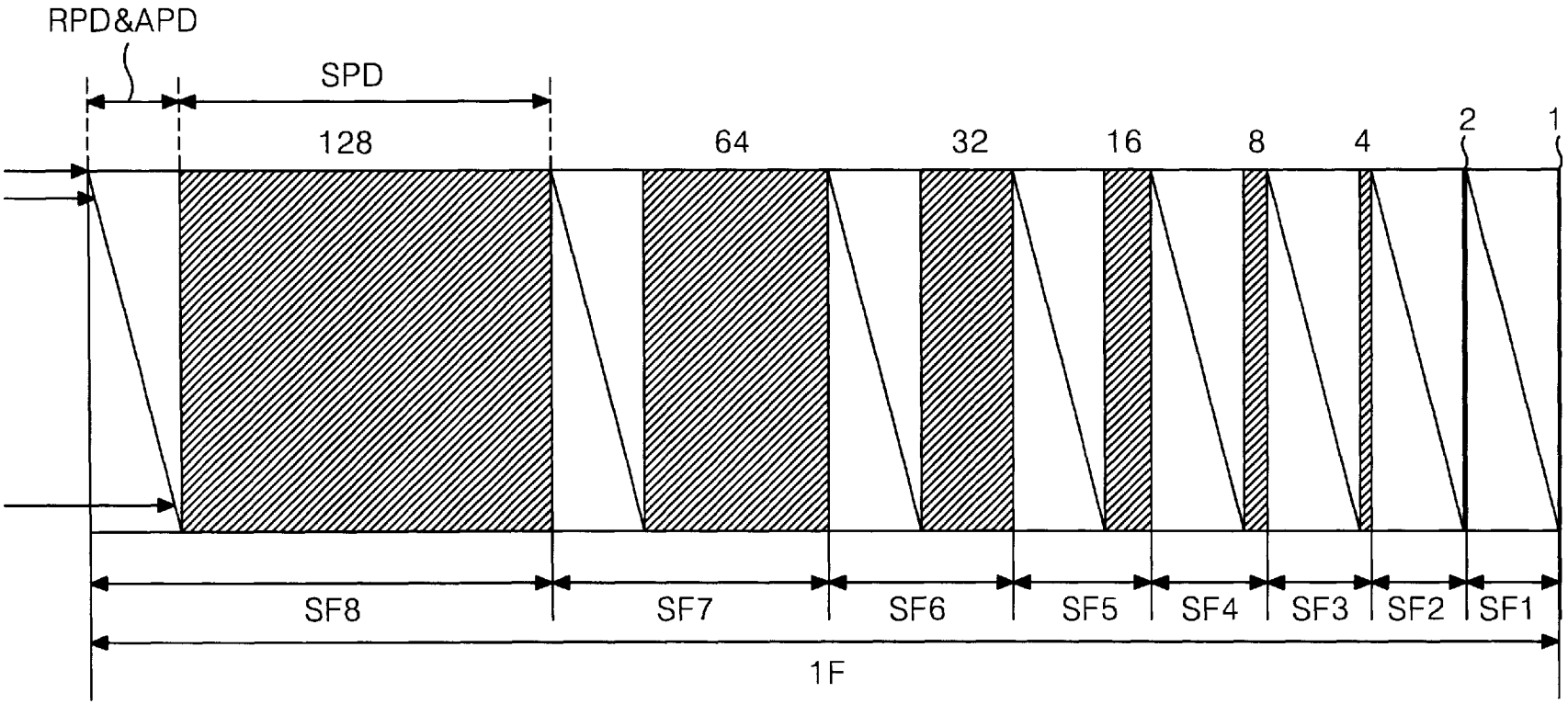
FIG. 3 RELATED ART
FIG. 3 illustrates a configuration of one frame according to a conventional sub-field driving method.
Figure 4:
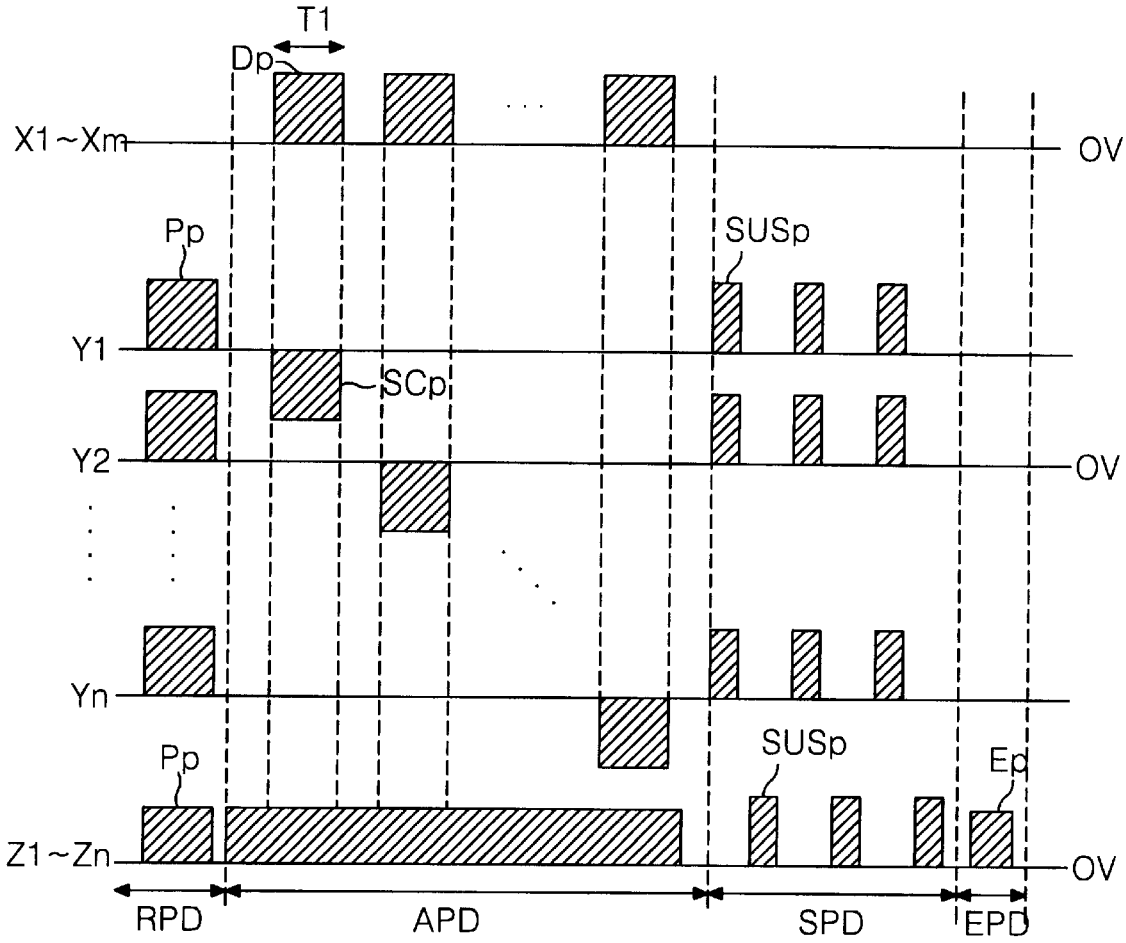
FIG. 4 RELATED ART
FIG. 4 is waveform diagrams of signals for driving the plasma display panel shown in FIG. 2.
Figure 5:
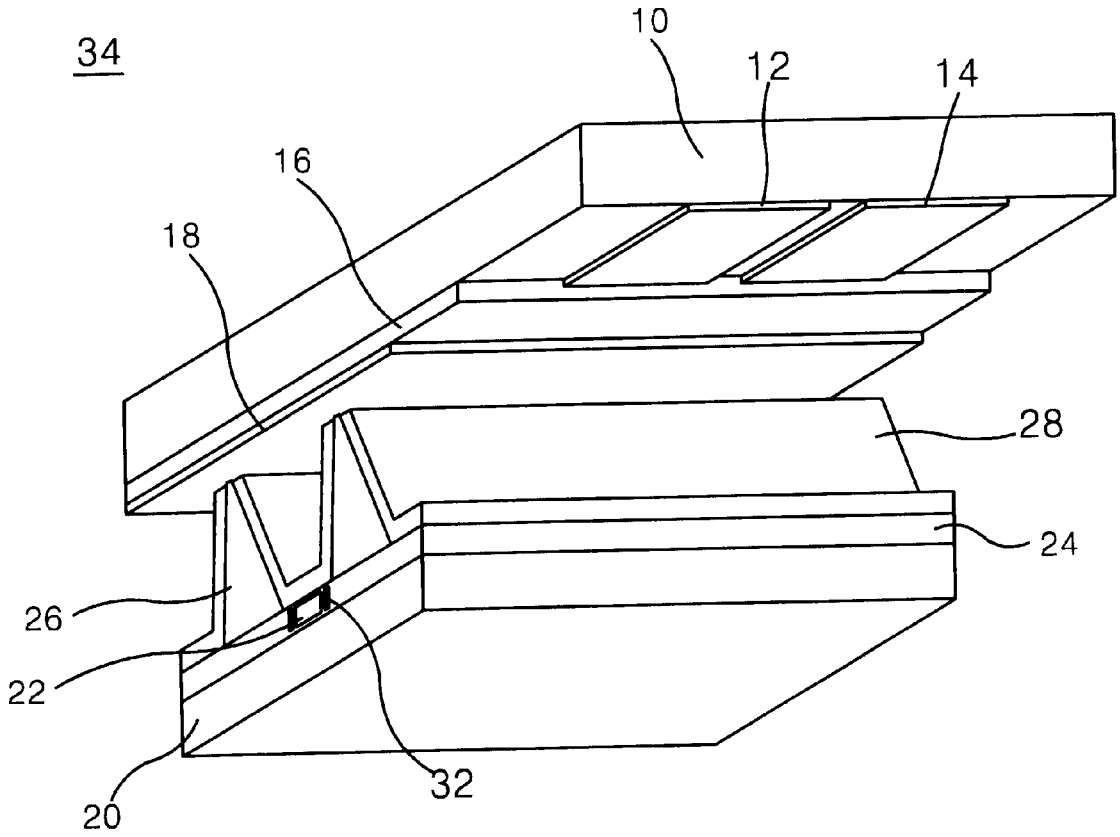
FIG. 5 RELATED ART
FIG. 5 is a perspective view showing a structure of a discharge cell of a conventional plasma display panel employing an auxiliary discharge.
Figure 6:
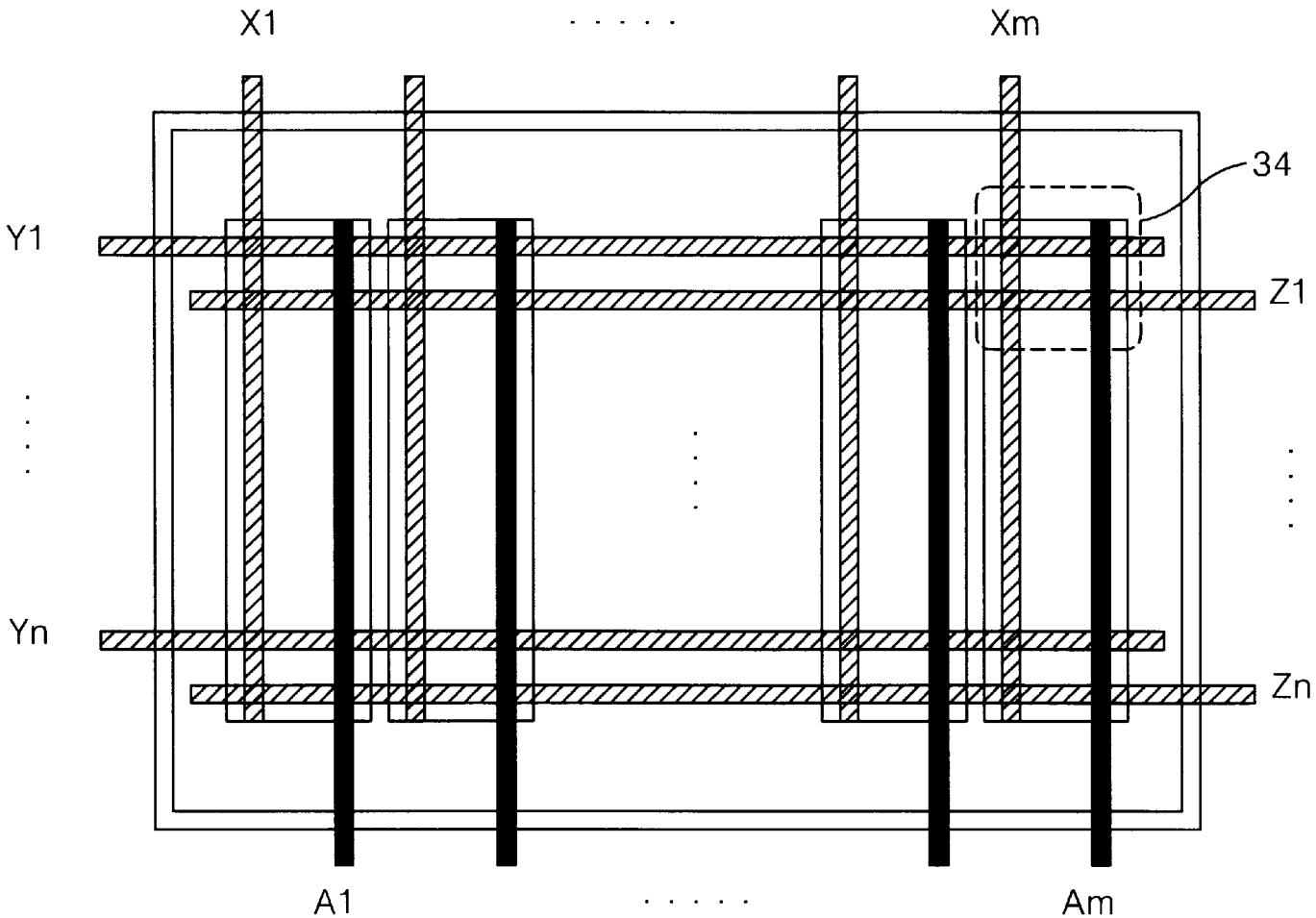
FIG. 6 RELATED ART
FIG. 6 is a plan view showing an entire electrode arrangement of a plasma display panel including the discharge cells of FIG. 5.
Figure 7:
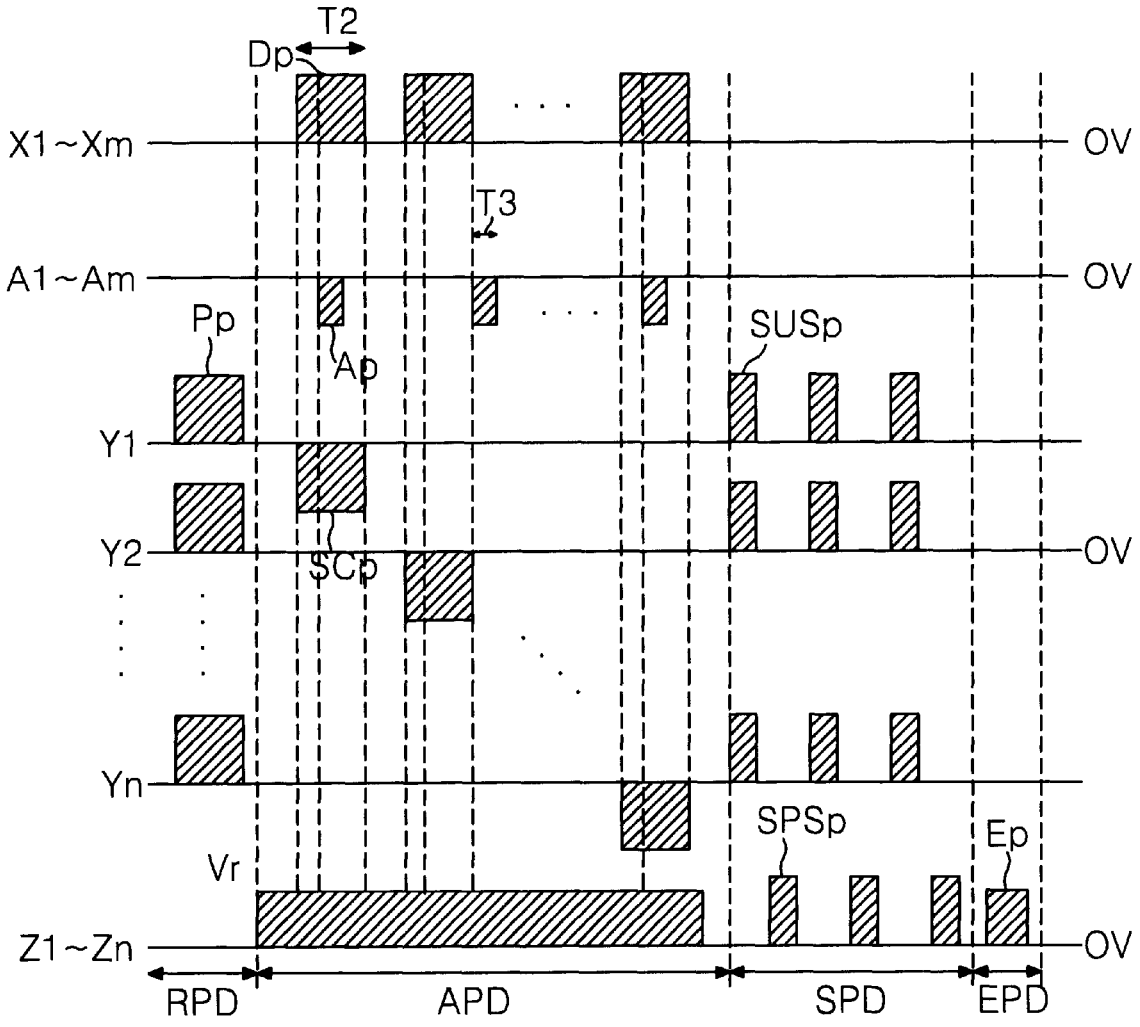
FIG. 7 RELATED ART
FIG. 7 is waveform diagrams of signals for driving the plasma display panel shown in FIG. 6.
Figure 8:
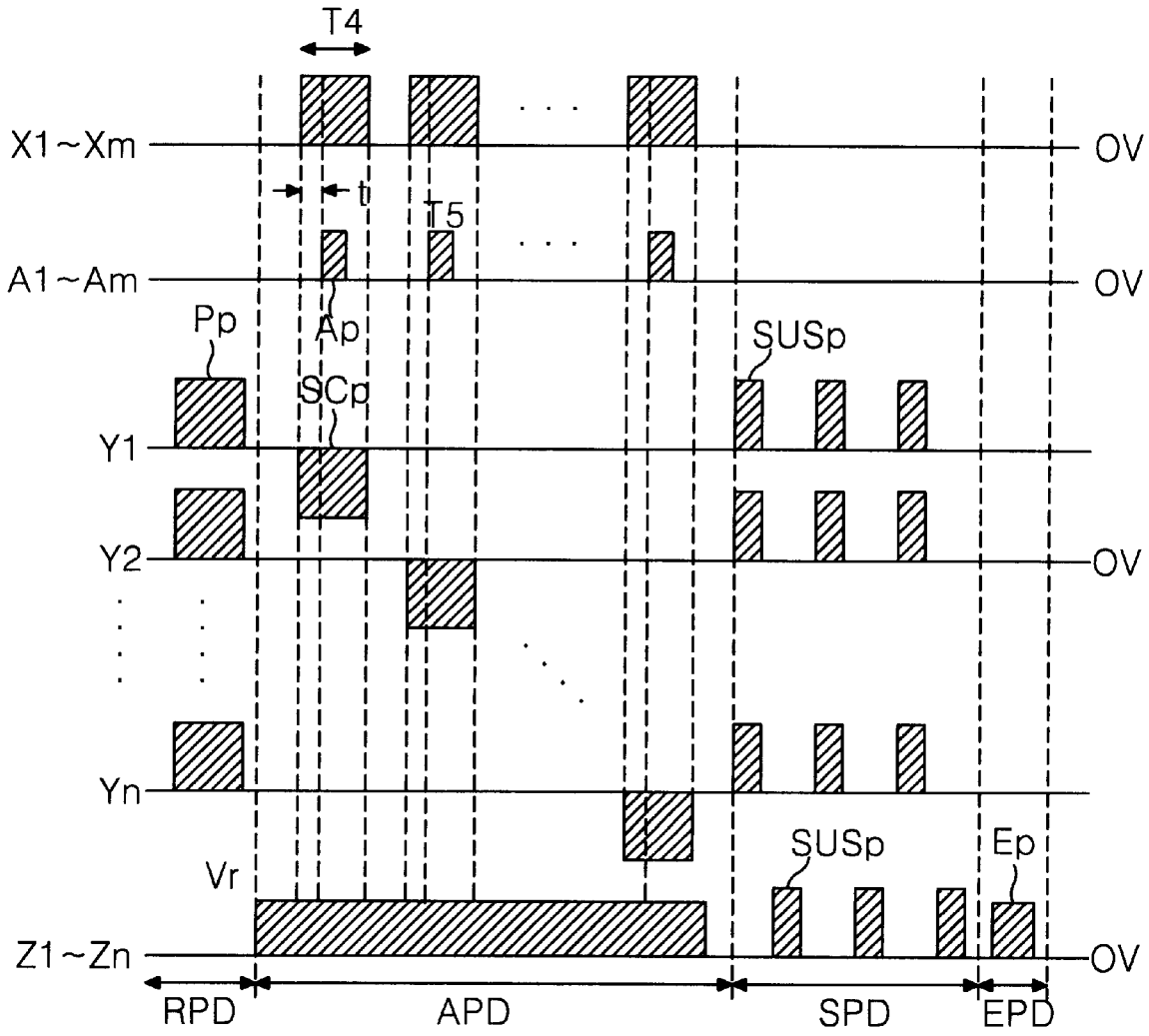
FIG. 8 is signal waveform diagrams for explaining a method of driving a plasma display panel according to a first embodiment of the present invention.

FIG. 8 explains a method of driving a plasma display panel (PDP) according to a first embodiment of the present invention, and is waveform diagrams of driving signals applied to the PDP employing an auxiliary discharge as shown in FIG. 6 during a certain sub-field interval. During the address discharge, an auxiliary discharge is generated between an address electrode line X and an auxiliary electrode line A in the prior art, whereas an auxiliary discharge is generated between a scanning electrode line Y and the auxiliary electrode lie A in the present invention.

In a reset interval RPD, a priming pulse Pp is commonly applied to the scanning/sustaining electrode lines Y1 to Yn and the common sustaining electrode lines Z1 to Zn. By this priming pulse Pp, a reset discharge is generated at all of the discharge cells 34 to initialize them. In an address interval APD, a negative(−) scanning voltage pulse SCp is line-sequentially applied to the scanning/sustaining electrode lines Y1 to Yn. At the same time, a positive(+) data pulse Dp according to a logical value of a data is applied to the address electrode lines X1 to Xm. Also, whenever the data pulse Dp is applied, a positive (−) auxiliary pulse Ap is applied to the auxiliary electrode lines A1 to Am. Accordingly, at discharge cells to which a positive(+) data pulse Dp is applied, an address discharge is generated between the address electrode and the scanning/sustaining electrode and an auxiliary discharge is further generated between the address electrode and the auxiliary electrode. In this case, a positive auxiliary pulse Ap is applied to the auxiliary electrode for an auxiliary discharge, so that an erroneous discharge between the address electrode and the auxiliary electrode can be prevented like the prior art. Sufficient priming charged particles are produced at the discharge space by virtue of the auxiliary discharge, a pulse width T4 of a drive pulse for an address discharge, that is, the data pulse Dp and the scanning pulse SCp can be shortened into less than 1 $\mu$s. This is because a discharge delay phenomenon can be prevented by a sufficient production of the charged particles according to the auxiliary discharge.

More specifically, a displacement current for charging electric charges to an equivalent capacitor of the corresponding discharge cell within a discharge cell to which a data pulse Vd and a scanning pulse −Vs are simultaneously applied. Then, after charging of the capacitor, a plasma discharge is generated.

In the prior art, since a discharge delay time was long due to a displacement current in such a capacitor charging process, a width of an address drive pulse was set to more than 2.4 $\mu$s. Thus, it was difficult to shorten an address interval. However, such a discharge delay time usually is inversely proportional to an amount of charged particles produced within the discharge cell. Accordingly, to produce more lots of charged particles by the auxiliary discharge can prevent a discharge delay phenomenon. Herein, the auxiliary pulse Ap is applied at a desired time difference t from the data pulse Dp and the scanning pulse SCp. A pulse width T5 of the auxiliary pulse Ap is set to have a smaller value than a pulse width T4 of the data pulse Dp and the scanning pulse SCp, that is, less than 0.5 $\mu$s. Charged particles are charged in the discharge cell during a desired time (t) of charging interval after application of the data pulse Dp and the scanning pulse SCp and an auxiliary discharge pulse Va for a discharge is further applied to the auxiliary electrode line A after a time of t, thereby preventing a discharge delay phenomenon caused by a displacement current upon charging of electric charges. In other words, a certain amount of charged particles are produced within the discharge cell and then a discharge voltage is again applied to cause a discharge, so that a discharge delay time can be dramatically reduced and a reliable addressing can be assured.

Wall charges are formed at discharge cells in which the address discharge is generated. In this address interval APD, a desired constant voltage Vr is applied to the common sustaining electrode lines Z1 to Zn to prevent a discharge from being generated between each common sustaining electrode line and each address electrode line. In a sustaining interval SPD, a sustaining discharge is continuously generated only at the discharge cells in which wall charges have been produced by said address discharge with the aid of a sustaining pulse SUSp applied alternately to the scanning/sustaining electrode lines Y1 and Yn and the common sustaining electrode lines Z1 to Zn. Then, in a separate erasure interval EPD, an erasing pulse Ep is applied to the common sustaining electrode lines Z1 to Zn to interrupt the sustained discharge.

As described above, the present PDP driving method can largely shorten a width T4 of the address drive pulse into less than 1 $\mu$s using the auxiliary discharge. Owing to such a shortening of the width T4 of the address drive pulse, an address interval for each sub-field is largely shortened into more than two times to increase a sustaining interval to that extent, thereby being advantageous to a brightness improvement and a high-resolution panel driving.

Furthermore, the present PDP driving method has to appropriately select a voltage level of the auxiliary pulse Ap such that a voltage difference between the scanning electrode line Y and the auxiliary electrode line A has a voltage level enough to cause an auxiliary discharge. However, a voltage of the auxiliary pulse Ap must be set to be smaller than that of the data pulse Dp. This is because, if a voltage of the auxiliary pulse Ap is set to a value as large as that of the data pulse Dp, an erroneous discharge between the auxiliary electrode line A and the scanning electrode line Y may be generated at a cell to which the data pulse Dp is not applied. In order to prevent this erroneous discharge, a voltage value of the auxiliary pulse Ap is set appropriately. In addition, in the present PDP driving method, an auxiliary discharge is generated only at discharge cells in which charged particles have been charged by the data pulse Dp even though the auxiliary pulse Ap is commonly to all of the discharge cells. Accordingly, a deterioration problem of a picture contrast caused by an insufficient light-emission upon the auxiliary discharge can be effectively overcome.

Figure 9:
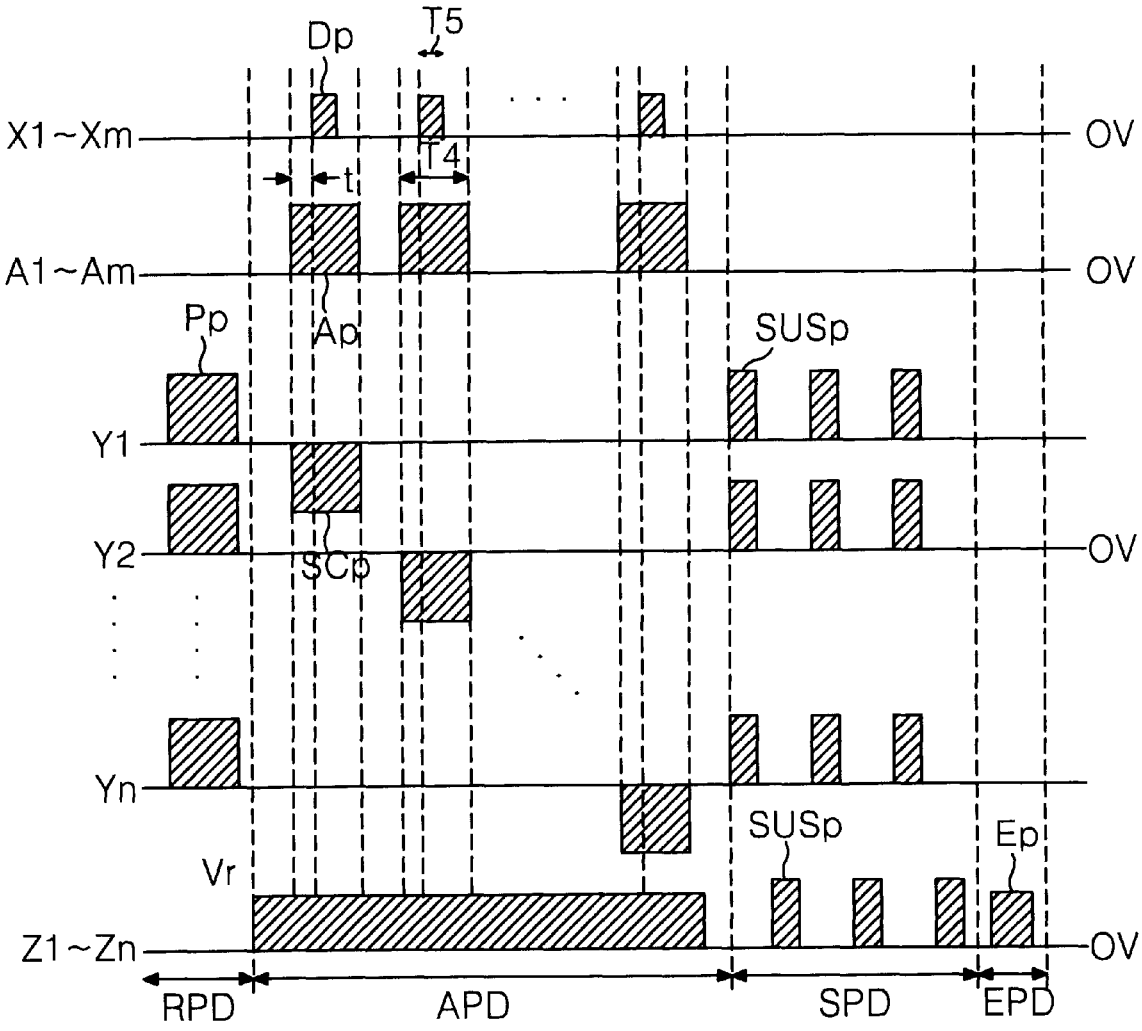
FIG. 9 is signal waveform diagrams for explaining a method of driving a plasma display panel according to a second embodiment of the present invention.

FIG. 9 explains a method of driving a plasma display panel (PDP) according to a second embodiment of the present invention, and is waveform diagrams of driving signals applied to the PDP employing an auxiliary discharge as shown in FIG. 6 during a certain sub-field interval. The PDP driving method according to the second embodiment makes a driving of the PDP with driving waveforms for the address electrode lines X1 to Xm and the auxiliary electrode lines A1 to Am exchanged mutually when compared with the PDP driving method according to the first embodiment. More specifically, a positive(+) data pulse Dp having the same pulse width T4 as a scanning pulse SCp is applied to the auxiliary electrode lines A1 to Am in synchronization with the scanning pulse SCp, and then an auxiliary pulse Ap for causing an auxiliary discharge is applied to the address electrode lines X1 to Xm at the rising edge of the data pulse Dp after a t time delay. A voltage difference between a auxiliary electrode line Ap supplied with a positive(+) data pulse Dp and a scanning/sustaining electrode line Y supplied with a negative(−) scanning pulse SCp causes a charging of charged particle in the discharge cell. After a t time delay, a plasma discharge is generated at discharge cells in which a certain amount of charged particles have been charged by the auxiliary pulse Ap applied to an address electrode line X. since a discharge voltage, which is a voltage difference between the auxiliary pulse Ap and the scanning pulse SCp is loaded to the discharge cells in a state in which a certain amount of charged particles have been charged in the cells, a plasma discharge is generated rapidly. Accordingly, a discharge delay time is largely reduced, so that a width T4 of an address drive pulse can be largely shortened into less than lots. In addition, since charged particles are produced only at discharge cells in which the data pulse Dp has been applied to the auxiliary electrode line A, an auxiliary discharge is generated only at discharge cells to which the data pulse Dp has been applied even though the auxiliary pulse Ap is commonly to all of the discharge cells, thereby preventing an erroneous discharge caused by the auxiliary discharge.

Figure 10:
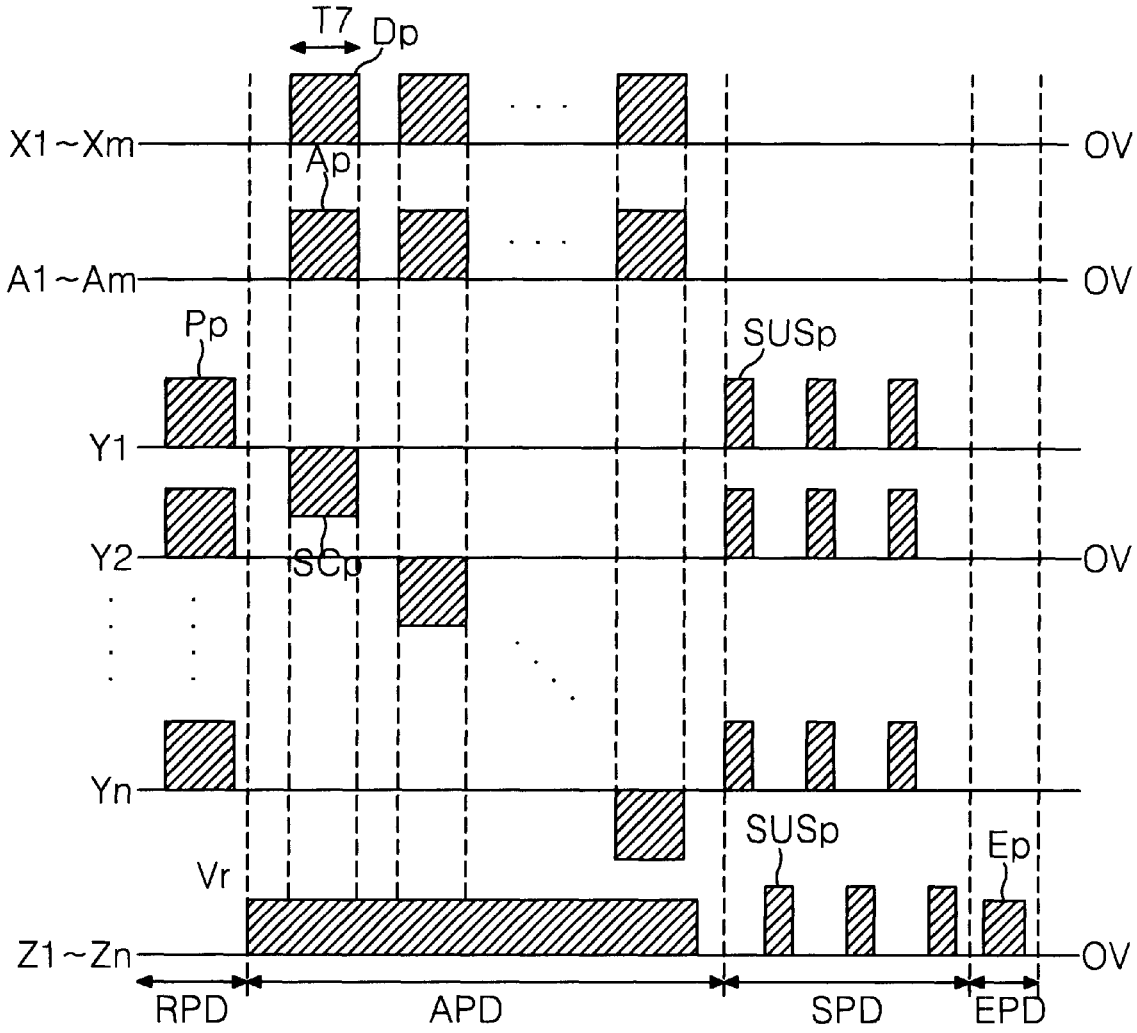
FIG. 10 is signal waveform diagrams for explaining a method of driving a plasma display panel according to a third embodiment of the present invention.

FIG. 10 is waveform diagrams of drive signals for explaining a PDP driving method according to a third embodiment of the present invention. Referring to FIG. 10, in the third embodiment, a positive(+) auxiliary pulse Ap having the same voltage and pulse width T7 as a data pulse Dp is applied to auxiliary electrode lines A1 to Am at the same time. This auxiliary pulse Ap is commonly applied to all of the discharge cells, but is applied only to discharge cells to which the data pulse Dp is applied. An address discharge is generated between a scanning/sustaining electrode line Y supped with a negative(−) scanning pulse SCp and an address electrode line X supplied with a positive(+) data pulse Dp and, at the same time, an auxiliary discharge is generated between an auxiliary electrode line A supplied with a positive(+) auxiliary pulse Ap and said scanning/sustaining electrode line Y. Since a discharge delay phenomenon can be prevented by virtue of the auxiliary discharge, a width T7 of the address drive pulse can be largely shortened into less than 1 $\mu$s. Furthermore, the auxiliary pulse Ap having the same level and pulse width as the data pulse Dp also is applied to the auxiliary electrode line to increase a discharge possibility, so that a stable addressing can be obtained. Also, an erroneous problem and a contrast deterioration caused by the auxiliary discharge can be overcome.

Figure 11:
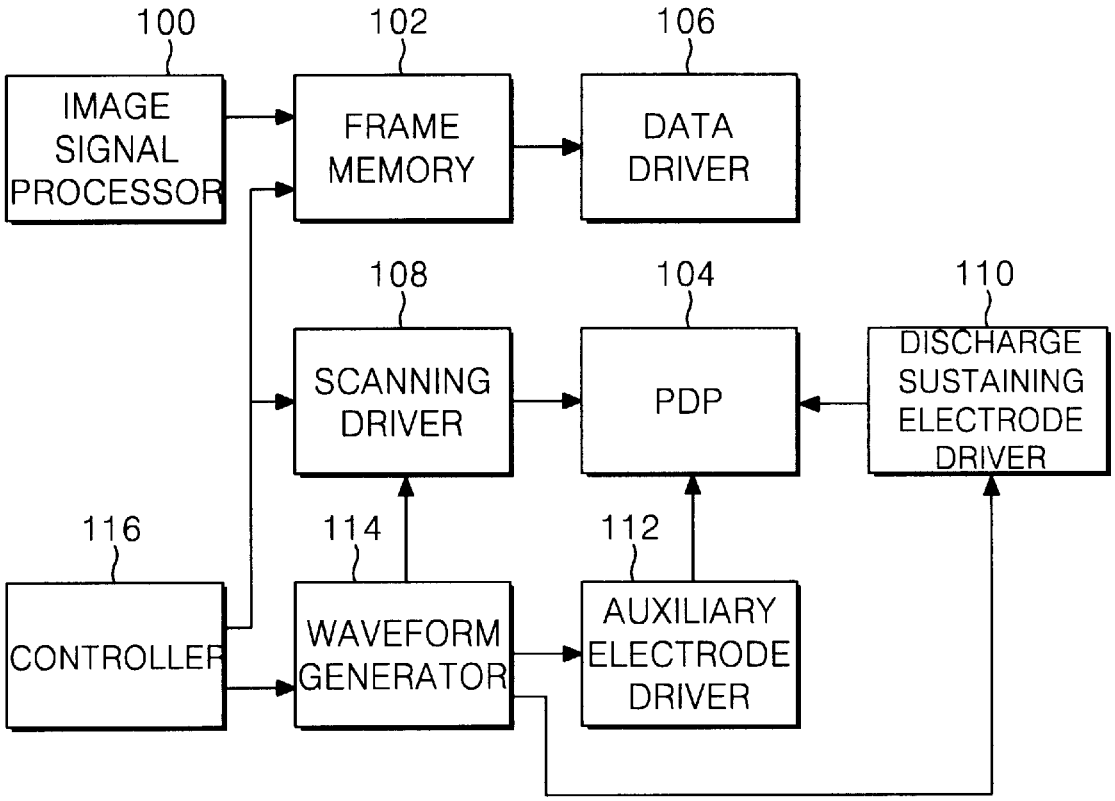
FIG. 11 is a block diagram showing a configuration of a driving apparatus employing said method of driving the plasma display panel according to the embodiments of the present invention.

FIG. 11 is a block diagram showing a configuration of a driving apparatus for applying a drive waveform shown in FIG. 10 to the PDP. In FIG. 11, the FDP driving apparatus includes an image signal processor 100 for processing an image data, a frame memory 102 for storing the image data from the image signal processor 100 frame by frame, a data driver 106 for applying the data pulse Dp to the data electrode lines X1 to Xm of a PDP 104 sequentially for each one line in accordance with the image data transmitted from the frame memory 102, a scanning driver 108 for sequentially applying the scanning pulse SCp and a sustaining pulse SUSp to the scanning/sustaining electrode lines Y1 to Yn of the PDP 104 every horizontal period, a sustaining electrode driver 110 for applying the sustaining pulse SUSp to the sustaining electrode line Z1 to Zn, and an auxiliary electrode driver 112 for applying the auxiliary pulse Ap to the auxiliary electrode lines A1 to Am. Further, the PDP driving apparatus includes a waveform generator 114 for generating a pulse waveform to apply it each of the drivers 108, 110 and 112, and a controller 116 for controlling the frame memory 102, the scanning driver 108 and the waveform generator 114 so as to control an application time of a pulse applied to each electrode line. The controller 116 controls the waveform generator 114 and the auxiliary electrode driver 112 to apply the auxiliary discharge pulse Va to the auxiliary electrode line A only at the discharge cells in which the data pulse Dp and the scanning pulse SCp co-exist in the address interval of each sub-field.

Figure 12:
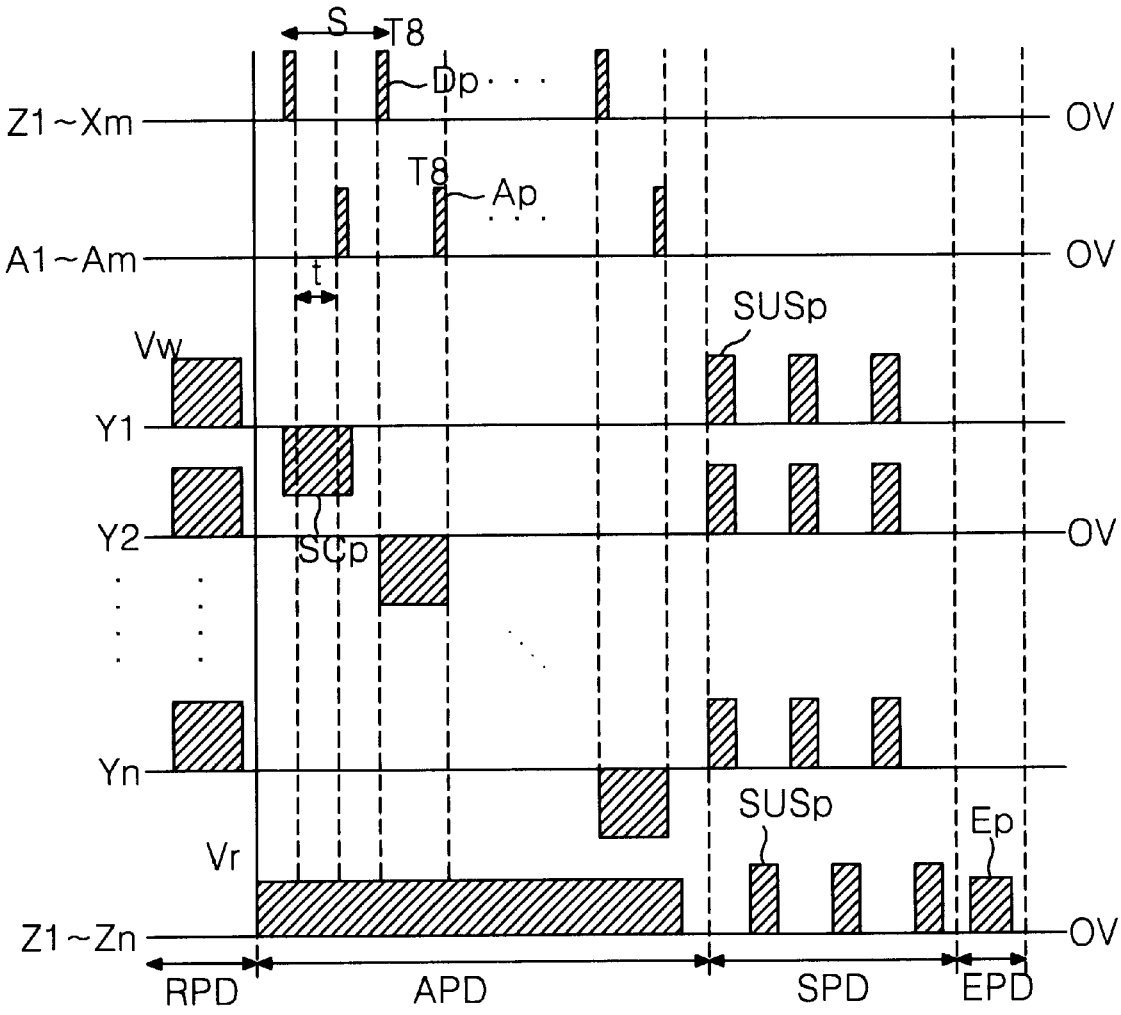
FIG. 12 is signal waveform diagrams for explaining a method of driving a plasma display panel according to a fourth embodiment of the present invention.

FIG. 12 is waveform diagrams of drive signals for explaining a PDP driving method according to a fourth embodiment of the present invention. Referring to FIG. 12, a data pulse Dp having a relatively small pulse width TB is applied to the address electrode lines X1 to Xm at a time when a scanning pulse SCp is applied to each scanning line. Then, after a desired delay time t, an auxiliary pulse having the same voltage and pulse width T8 as the data pulse Dp is applied to the auxiliary electrode lines A1 to Am. In this case, the pulse width T8 of the data pulse Dp, the pulse width T8 of the auxiliary pulse Ap and the delay time t is appropriately such that a period S of the data pulse Dp becomes less than 1 $\mu$s. Herein, the delay time t may be "0". Since a voltage level of the auxiliary pulse Ap is higher than that of the data pulse Dp, an to auxiliary pulse Ap is applied only to discharge cells supplied to the data pulse Dp so as to prevent an erroneous discharge from being generated between the auxiliary electrode line A and the scanning electrode line Y. Such a selective application control of the auxiliary pulse Ap is carried out by means of the driving apparatus shown in FIG. 11. Charged particles produced by an address discharge between the address electrode line X supplied with a positive(+) data pulse Dp and the scanning/sustaining electrode line Y supplied with a negative(−) scanning pulse SCp serves as a seed. Then, a discharge is again generated between the auxiliary electrode line A and the scanning/sustaining electrode line Y, so that a discharge delay phenomenon caused by a lack of space charges can be restrained and more reliable address discharge can be obtained. In addition, the auxiliary pulse Ap is selectively applied only to cells to which the data pulse Dp is applied, so that an erroneous discharge and a contrast deterioration caused by an insufficient light-emission can be prevented.

Figure 13:
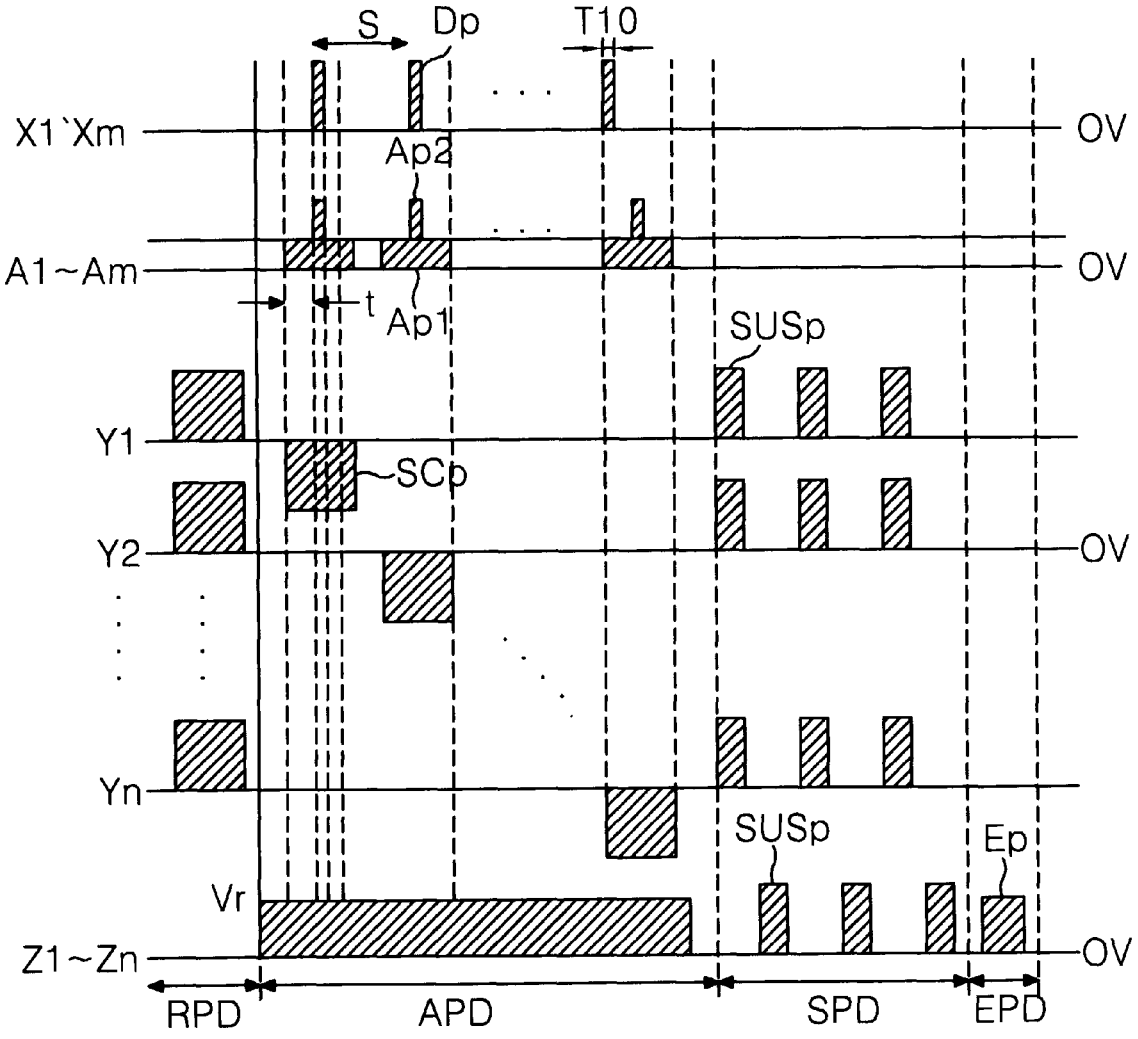
FIG. 13 is signal waveform diagrams for explaining a method of driving a plasma display panel according to a fifth embodiment of the present invention.

FIG. 13 is waveform diagrams of drive signals for explaining a PDP driving method according to a fifth embodiment of the present invention. Referring to FIG. 13, in an address interval APD, a low voltage level of first auxiliary pulse Ap1 is applied to the auxiliary electrode line A at the rising edge thereof supplied with a scanning pulse SCp for each scanning line. after a desired delay time t, a data pulse Dp is applied to the address electrode line X. At the same time, the first auxiliary pulse including a second auxiliary pulse Ap2 is applied to the auxiliary electrode line A only at discharge cells to which the data pulse Dp is applied. A pulse width T10 of the data pulse Dp and the second auxiliary pulse Ap2 applied at this time is set to a small value such that an application period S of the data pulse Dp is less than 1 $\mu$s. A pulse width of the first auxiliary pulse Ap1 is set to be equal to that of the scanning pulse SCp. As a result, the auxiliary pulses Ap1 and Ap2 having three voltage levels are applied to the auxiliary electrode line A to permit a low voltage driving. Herein, the first auxiliary pulse Ap1 is commonly applied to all of the discharge cells, whereas the second auxiliary pulse Ap2 added to the first auxiliary pulse Ap1 is applied only to discharge cells to which the data pulse Dp is applied. A charging of electric charges in the discharge cells is made by a voltage difference between the scanning/sustaining electrode line Y supplied with a negative scanning pulse SCp and the auxiliary electrode line A supplied with a positive first auxiliary pulse Ap1. After a delay time t, an address discharge is generated by a voltage difference between the data electrode line X supplied with a positive data pulse Dp and said scanning/sustaining electrode line Y. At the same time, an auxiliary discharge is generated between the auxiliary electrode line A supplied with the second auxiliary pulse Ap2 added to the first auxiliary pulse Ap1. Sufficient charged particles are produced in the discharge space by virtue of the auxiliary discharge, so that a discharge delay time can be largely shortened and a reliable address discharge can be obtained.

As described above, according to the present invention, charged particles charged in the discharge cells by a discharge voltage between the data electrode and the scanning electrode uses as a seed to apply the a positive auxiliary discharge pulse to the auxiliary electrode arranged in parallel to the data electrode, thereby causing an auxiliary discharge. Thus, a discharge delay time during the address discharge is largely shortened, so that an address interval can be largely shortened into more than two times in comparison to the prior art. Accordingly, a stable high-speed addressing becomes possible, so that effects such as a brightness improvement, an easy increase of sub-fields increase, an easy driving of a high-resolution panel, a reduction of panel manufacturing cost, etc. can be obtained. Also, a pulse having the same polarity as the data pulse is applied to the auxiliary electrode to cause the auxiliary discharge along with the scanning electrode, so that an erroneous discharge can be prevented and a stable address discharge can be obtained. In addition, an auxiliary pulse having the same pulse as the data pulse is applied to the auxiliary electrode in accordance with the data pulse to cause an auxiliary discharge along with the scanning electrode, so that it becomes possible to prevent an erroneous discharge as well as to improve a contrast.

Although the present invention has been explained by the embodiments shown in the drawings described above, it should be understood to the ordinary skilled person in the art that the invention is not limited to the embodiments but rather that various changes or modifications thereof are possible without departing from the spirit of the invention. Accordingly, the scope of the invention shall be determined only by the appended claims and their equivalents.

What is claimed is:

1. An address driving method in a driving method of a plasma display panel comprising a plurality of discharge cells including an address electrode, a scanning/sustaining electrode arranged perpendicularly to the address electrode, and a sustain electrode arranged in parallel to the sustaining/scanning electrode, comprising:

applying pulses to the address electrode and the scanning/sustaining electrode thereby generating an address discharging for selecting a discharge cell; and applying a sustain pulse to the scanning/sustaining electrode and the sustain electrode, to thereby generate a sustain discharging for sustaining the discharging in the selected discharge cell, wherein the generating the address discharging comprises, applying a data pulse to the address electrode and applying a scanning pulse having a polarity contrary to a polarity of the data pulse to the scanning/sustaining electrode thereby generating the address discharge in the selected discharge cell, and applying an auxiliary pulse having the same polarity as the data pulse to an auxiliary electrode parallel to the address electrode thereby generating an auxiliary discharge.

2. The method as claimed in claim 1, wherein a pulse width of the data pulse and the scanning pulse is set to less than 1 $\mu$s.

3. The method as claimed in claim 1, wherein the auxiliary pulse is applied after a desired time from application of the data pulse, and a pulse width and a voltage level of the auxiliary pulse are set to have smaller values more than those of the data pulse.

4. The method as claimed in claim 1, wherein the auxiliary pulse has the same pulse width and voltage level as the data pulse and is applied at the same application time as the data pulse.

5. The method as claimed in claim 1, wherein the data pulse is applied at the rising edge of the scanning pulse, and the auxiliary pulse is applied prior to the falling edge of the scanning pulse after a prescribed time so the auxiliary discharge contributes to the address discharging.

6. The method as claimed in claim 5, wherein a pulse width of the data pulse and the auxiliary pulse is set to less than 0.5 $\mu$s.

7. The method as claimed in claim 1, further comprising:

applying a first auxiliary pulse having the same pulse width as and a lower voltage than the scanning pulse; and applying a data pulse having a relatively small pulse width at a middle time of the scanning pulse and applying a second auxiliary pulse having the same pulse width as the data pulse and a higher voltage than the first auxiliary pulse which is added to the first auxiliary pulse.

8. The method as claimed in claim 1, wherein the auxiliary pulse is applied only to the discharge cells supplied with the data pulse.

9. The method as claimed in claim 1, wherein the driving method of the plasma display panel drives a reset interval, an address interval and a sustaining interval for each of a plurality of sub-fields representing a frame.

10. The method as claimed in claim 9, wherein driving the address interval comprises said generating the address discharging, and wherein driving the sustaining interval comprises said applying the sustain pulse to the scanning/sustaining electrode and the sustain electrode to thereby generate the sustain discharging.

11. An address driving method in a plasma display panel having a plurality of discharge cells, comprising:

applying pulses to an address electrode and a scanning/sustaining electrode intersecting each other for generating an address discharging for a selected discharge cell; and applying a sustain pulse to the scanning/sustaining electrode and a sustain electrode for generating a sustain discharging for sustaining the discharging in the selected discharge cell, wherein the generating the address discharging comprises, applying a data pulse to the address electrode and applying a scanning pulse to the scanning/sustaining electrode thereby generating an address discharge in the selected discharge cell, and applying an auxiliary pulse to an auxiliary electrode parallel to the address electrode thereby generating an auxiliary discharge, wherein the auxiliary pulse is applied after a desired time from application of the data pulse, and a pulse width and a voltage level of the auxiliary pulse are set to have smaller values than those of the data pulse.

12. The method as claimed in claim 11, wherein the scanning pulse to the scanning/sustaining electrode has a polarity contrary to the polarity of the data pulse, and wherein the auxiliary pulse has the same polarity as the data pulse.

13. An address driving method in a plasma display panel having a plurality of discharge cells, comprising:

applying pulses to an address electrode and a scanning/sustaining electrode intersecting each other for generating an address discharging for a selected discharge cell; and applying a sustain pulse to the scanning/sustaining electrode and a sustain electrode for generating a sustain discharging for sustaining the discharging in the selected discharge cell, wherein the generating the address discharging comprises, applying a data pulse to the address electrode and applying a scanning pulse to the scanning/sustaining electrode thereby generating an address discharge in the selected discharge cell, and applying an auxiliary pulse to an auxiliary electrode parallel to the address electrode thereby generating an auxiliary discharge, wherein the applying the auxiliary pulse comprises, applying a first auxiliary pulse having the same or smaller pulse width as and a lower voltage than the scanning pulse, and applying the data pulse having a relatively small pulse width during the scanning pulse and applying a second auxiliary pulse during the first auxiliary pulse having a voltage based on the first auxiliary pulse which is added to the first auxiliary pulse.

14. The method of claim 13, wherein the scanning pulse to the scanning/sustaining electrode has a polarity contrary to the polarity of the data pulse, and wherein the auxiliary pulse has the same polarity as the data pulse.

15. The method of claim 13, wherein the voltage of the first auxiliary pulse and the second auxiliary pulse combined are greater than a first prescribed threshold.

16. A The method of claim 13, wherein the data pulse is applied during the second auxiliary pulse, and wherein voltages of the data pulse, the first auxiliary pulse and the second auxiliary pulse added together are greater than a second prescribed threshold.

17. The method of claim 13, wherein each discharge cell comprises a cell region that includes corresponding address and auxiliary electrodes substantially parallel to each other that both cross corresponding sustain and scanning/sustain electrodes.

* * * * *